US005186100A

United States Patent [19]

Turturro et al.

[11] Patent Number: 5,186,100

[45] Date of Patent: Feb. 16, 1993

[54] INTERCHANGEABLE INKER HAVING ENCLOSED TRANSMISSION

[75] Inventors: Michael Turturro, New City, N.Y.; Enn Sirvet, Washington Township, Bergen County, N.J.

[73] Assignee: Sequa Corporation, New York, N.Y.

[21] Appl. No.: 821,650

[22] Filed: Jan. 16, 1992

[51] Int. Cl.[5] ..... B41F 17/08

[52] U.S. Cl. ..... 101/40; 101/350

[58] Field of Search ..... 101/38.1, 39, 40, 205-209, 101/348, 349, 350, 351, 352

[56] References Cited

U.S. PATENT DOCUMENTS

| | | | |
|---|---|---|---|
| 3,223,028 | 12/1965 | Brigham | 101/40 |
| 3,601,049 | 8/1971 | Hamilton | 101/350 |
| 3,859,919 | 1/1975 | Skrypek et al. | 101/349 |
| 4,127,063 | 11/1978 | Dahlgren et al. | 101/350 X |
| 4,741,266 | 5/1988 | Stirbis et al. | 101/40 |
| 4,833,989 | 5/1989 | Sugiyama et al. | 101/349 |

*Primary Examiner*—Edgar S. Burr

*Assistant Examiner*—Christopher A. Bennett

*Attorney, Agent, or Firm*—Mitchell D. Bittman; Jerome M. Berliner

[57] ABSTRACT

Continuous motion apparatus for decorating cylindrical articles includes a plurality of removable and replaceable inker subassemblies each of which includes an inker section and a transmission section through which the inker section is mechanically connected to the main drive for the apparatus. Each inker subassembly applies a controlled film of ink to an individual associated printing cylinder that remains mounted to the main frame of the apparatus when its associated inker subassembly is dismounted from the main frame. The transmission section is a sealed unit that utilizes a liquid lubricant. Mounting stability is obtained by utilizing four mounting points where each inker unit engages the main frame. A readily releasable securing clamp is provided at each mounting point, and a sliding collar constitutes a readily disengageable coupling through which the input of the transmission section is driven by the main drive.

14 Claims, 9 Drawing Sheets

44
42
49
46
41
59
106
106
172
171
173
98a
99a
101
102
32
31a

INTERCHANGEABLE INKER HAVING ENCLOSED TRANSMISSION

BACKGROUND OF THE INVENTION

This invention relates to so-called continuous motion can decorators in general and relates more particularly to interchangeable inker units for such apparatus.

Continuous motion apparatus for decorating cylindrical containers are disclosed in U.S. Pat. No. 3,223,028 issued Dec. 14, 1965 to W. E. Brigham for An Interchangeable Inking Unit For Multi-Color Presses, U.S. Pat. No. 3,859,919 issued Jan. 14, 1975 to J. P. Skrypek et al. for An Inker Unit For Continuous-Motion Printer and U.S. Pat. No. 4,741,266 issued May 3, 1988 to J. S. Stirbis et al. for Can Decorating Apparatus. In each of these three patents the decorator sections include a continuously rotating blanket wheel which transfers an image to the container being decorated. The image on the blanket wheel is derived from differently colored image segments that are imprinted by individual printing plates that are mounted on separate plate cylinders. A different colored ink is applied to each printing plate by an interchangeable inker unit.

In the apparatus of the aforesaid U.S. Pat. Nos. 3,859,919 and 3,223,028 the plate cylinder is part of the inker unit while in the aforesaid U.S. Pat. No. 4,741,266 the plate cylinder remains mounted to the main frame of the apparatus when its associated inker unit is dismounted. The advantage of having the plate cylinder separate from the inker unit is that registry between the printing cylinders does not have to be reset each time an the inker unit is changed.

In the instant invention the plate cylinder remains in the apparatus when its associated inker unit is removed. This speeds up removal and replacement of inker units. Further economy of time is achieved without sacrificing performance by having four locating depressions in the edges of vertical main frame members and utilizing quick release clamps to secure the inker unit to the main frame. These clamps engage two strong parallel rods that are parts of the inker unit. The locating rods are received by the locating depressions on the main frame.

By having the locating depressions open at the edges of frame members the support rods enter the depressions by moving radially rather than by moving axially. In the aforesaid U.S. Pat. No. 4,741,266 mounting and dismounting of the inker unit is a cumbersome procedure because it must be moved sideways through an opening in the main frame, followed by the necessity of inserting dowels into locating depressions and then threading retainer bolts to secure the inker unit to the main frame.

The type of decorating equipment in question operates at relatively high speeds so that it is preferable to utilize a liquid lubricant for the transmission elements of the inker unit. In the instant invention the transmission elements are within a housing which is essentially closed to prevent liquid lubricant from leaking out and contaminating other elements of the apparatus and/or fouling up the work area.

In the instant invention each inker unit includes three spaced parallel plates, an ink distribution section disposed between the first two plates and a transmission section disposed between the other two plates. The transmission section is disposed within an enclosure that also confines the liquid lubricant for the transmission. An input shaft of the transmission section extends sideways (horizontally) outboard of the inker unit in alignment with a drive shaft that is rotatably supported on the main frame. Mounted on the transmission shaft is a spline-type slidable collar-like gear coupling that separably connects the drive shaft with the input shaft.

SUMMARY OF THE INVENTION

Accordingly, the primary object of the instant invention to provide an improved construction for interchangeable inker units of a continuous motion can decorators.

Another object is to provide an inker unit of this type constructed so that changeover is simplified.

Still another object is to provide inker units of this type having a transmission that utilizes a liquid lubricant and is totally enclosed.

A further object is to provide inker units of this type that are constructed so that there is a sturdy mounting to index and connect the inker units with the main frame of the decorating apparatus.

These objects as well as other objects of this invention shall become readily apparent after reading the following description of the accompanying drawings in which:

DETAILED DESCRIPTION OF THE DRAWINGS

Figure 1:
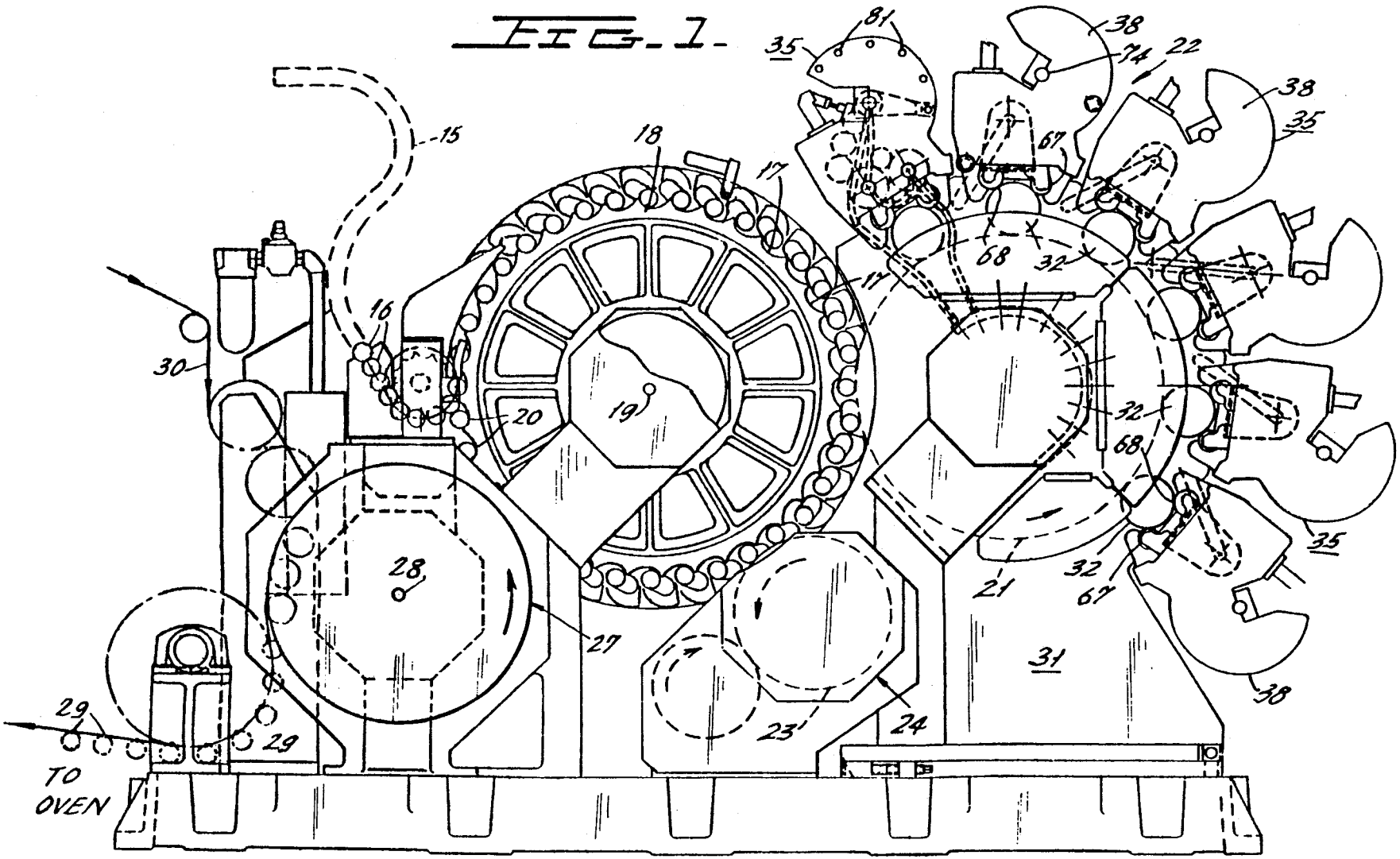
FIG. 1 is a side elevation of a continuous motion can decorator that includes interchangeable inker units constructed in accordance with teachings of the instant invention.
Figure 2:
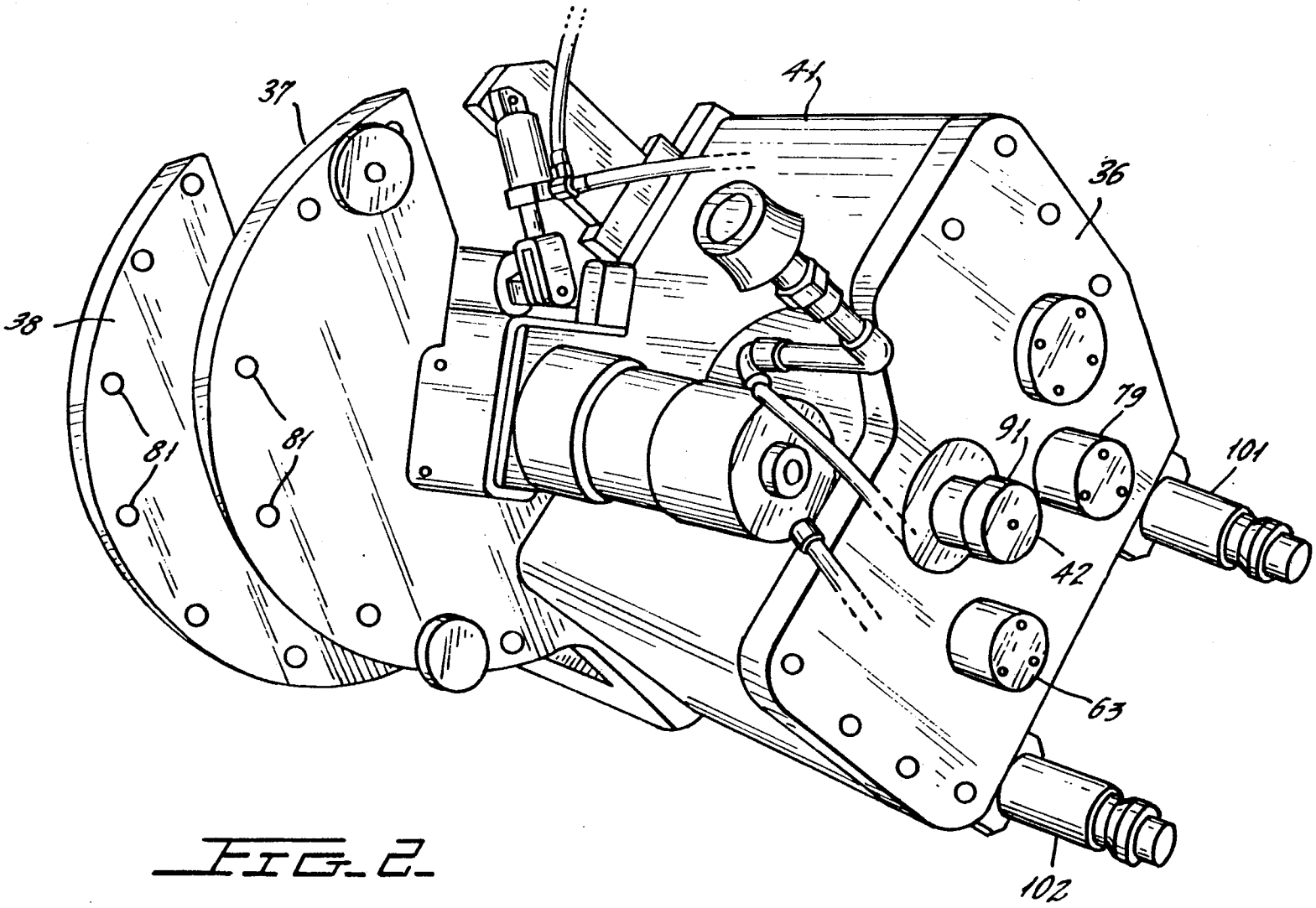
FIG. 2 is a perspective of an inker unit looking principally at the drive side thereof.
Figure 3:
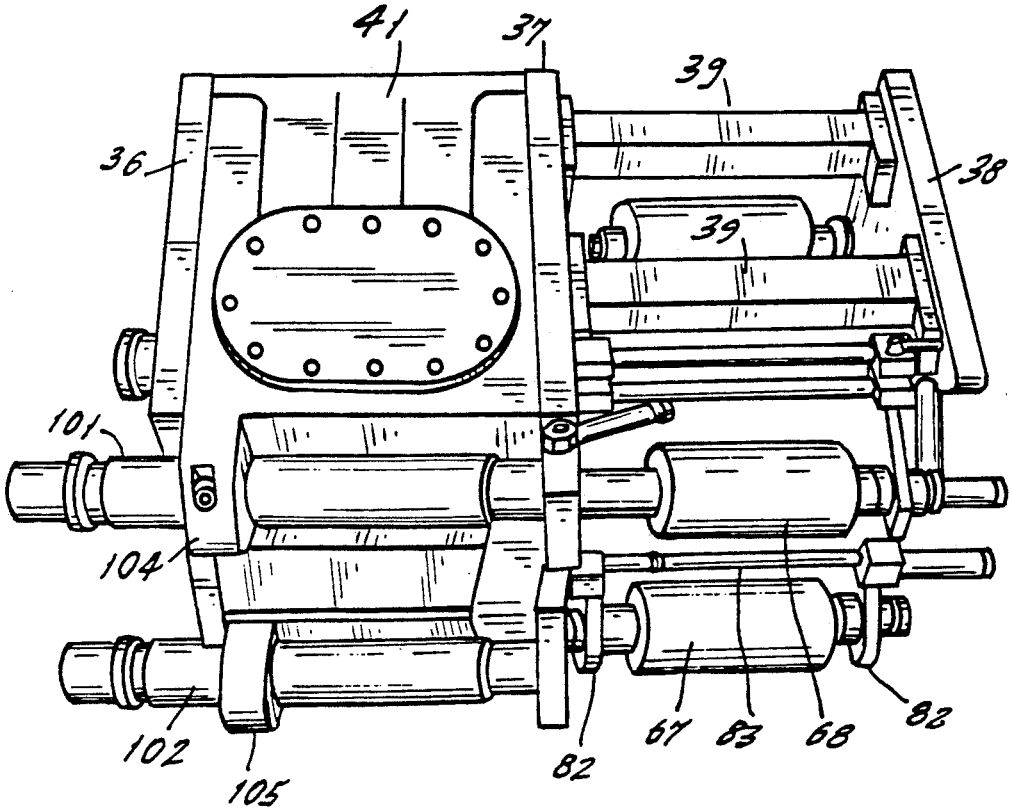
FIG. 3 is a perspective of the inker unit of FIG. 2 looking principally at the side thereof that faces the plate cylinder.

Now referring to the FIGS. and more particularly to FIG. 1 which illustrates a so-called continuous motion decorator for cylindrical objects, typically the body of a two-piece aluminum beverage can. The apparatus of FIG. 1 is of a type described in U.S. Pat. No. 3,766,851 issued Oct. 23, 1973 to E. Sirvet, J. P. Skrypek and E. J. Whelan for a Continuous Can Printer and Handling Apparatus, and includes decorator section 22 having a plurality of removable and replaceable inker units 35.

Briefly, the apparatus of FIG. 1 also includes infeed conveyor 15 which receives undecorated can 16 from a supply (not shown) and places them on cradles 17 located at the periphery of cradle wheel 18 that is continuously rotated by being keyed to horizontal shaft 19. Horizontal spindles or mandrels 20 are also mounted to wheel 18, with each spindle 20 being in angular alignment with an individual cradle 17, but being axially displaced therefrom. Each undecorated can 16 is transferred from cradle 17 to spindle 20, and while mounted to spindle 20, can 16 is decorated by being brought into engagement with continuously rotating image transfer blanket 21 of the multicolor printing press 22. Thereafter, and while still mounted to spindle 20, decorated can 16 has a protective film of varnish applied thereto by engagement with the periphery of applicator roll 23 in the overvarnish unit indicated generally by reference numeral 24.

Can 16 with decorations and a protective coating thereon is transferred from spindle 20 to a suction cup (not shown) mounted on transfer wheel 27 near the periphery thereof. The latter is continuously rotated about shaft 28 as a center. Cans 16 carried by transfer wheel 27 are deposited on generally horizontal pins 29 carried by chain-type output conveyor 30 which carries cans 16 through a curing oven (not shown).

Image transfer blanket 21 is rotatably mounted on main frame portion 31 of printing press 22 and is engaged by printing plates (not shown) on circumferentially spaced plate rolls or cylinders 32 that are mounted to frame 31, with each plate cylinder 32 being associated with an individual one of the readily removable and replaceable inker units 35.

Figure 8:
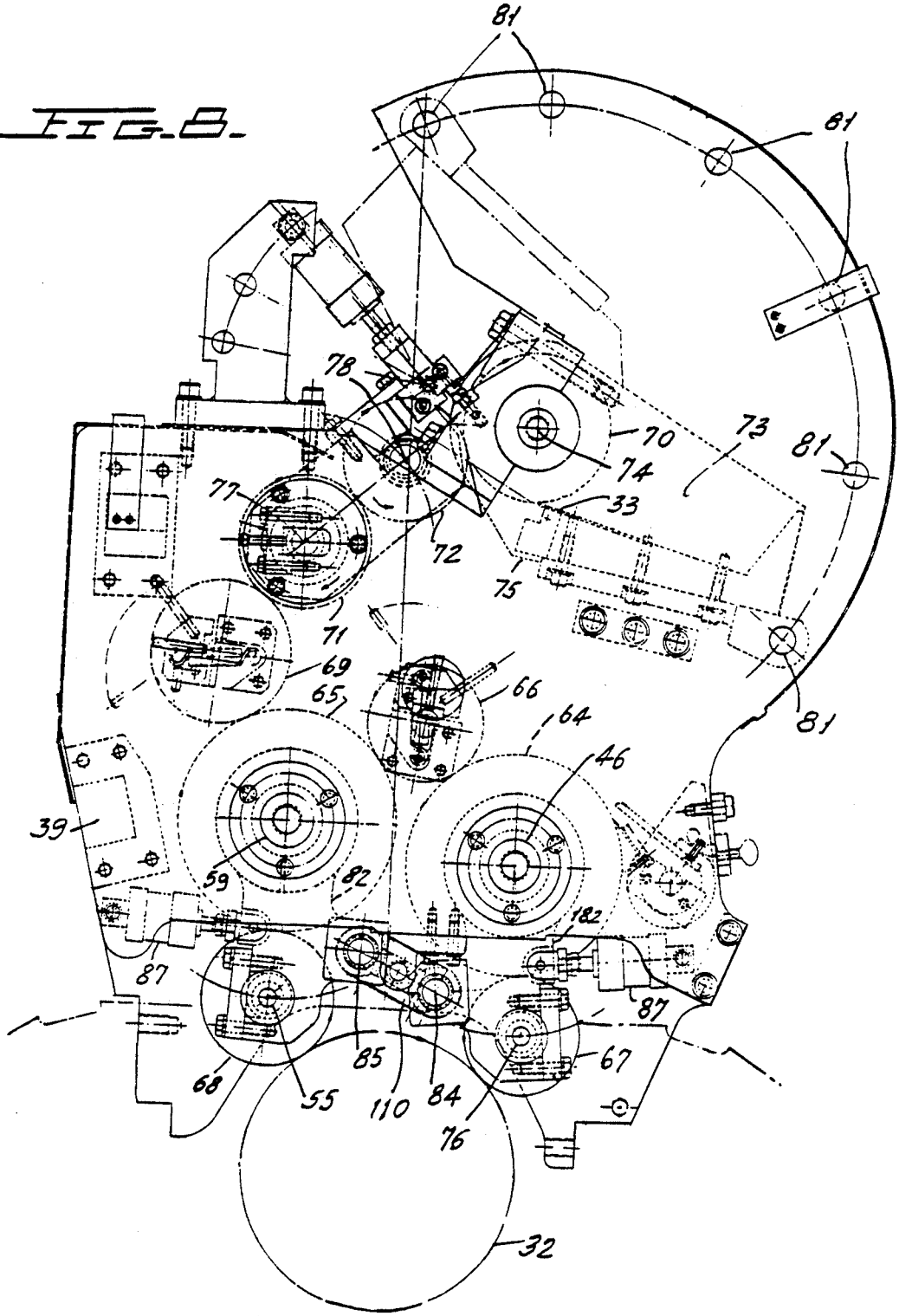
FIG. 8 is a side elevation of the ink distribution section looking in the direction of arrows 8—8 of FIG. 5.

The elements of inker unit 35 are supported by three parallel spaced plates 36, 37, 38. A pair of rods 39 (FIGS. 6 and 8) establish and maintain the spacing between plates 37, 38, and the spacing between plates 36 and 37 is maintained by unitary closed loop wall structure 41. Disposed between plates 36, 37 and supported thereby is a transmission which shall be hereinafter described. Disposed between and supported by plates 37, 38 are the elements (to be hereinafter described) constituting an inking section.

Figure 4:
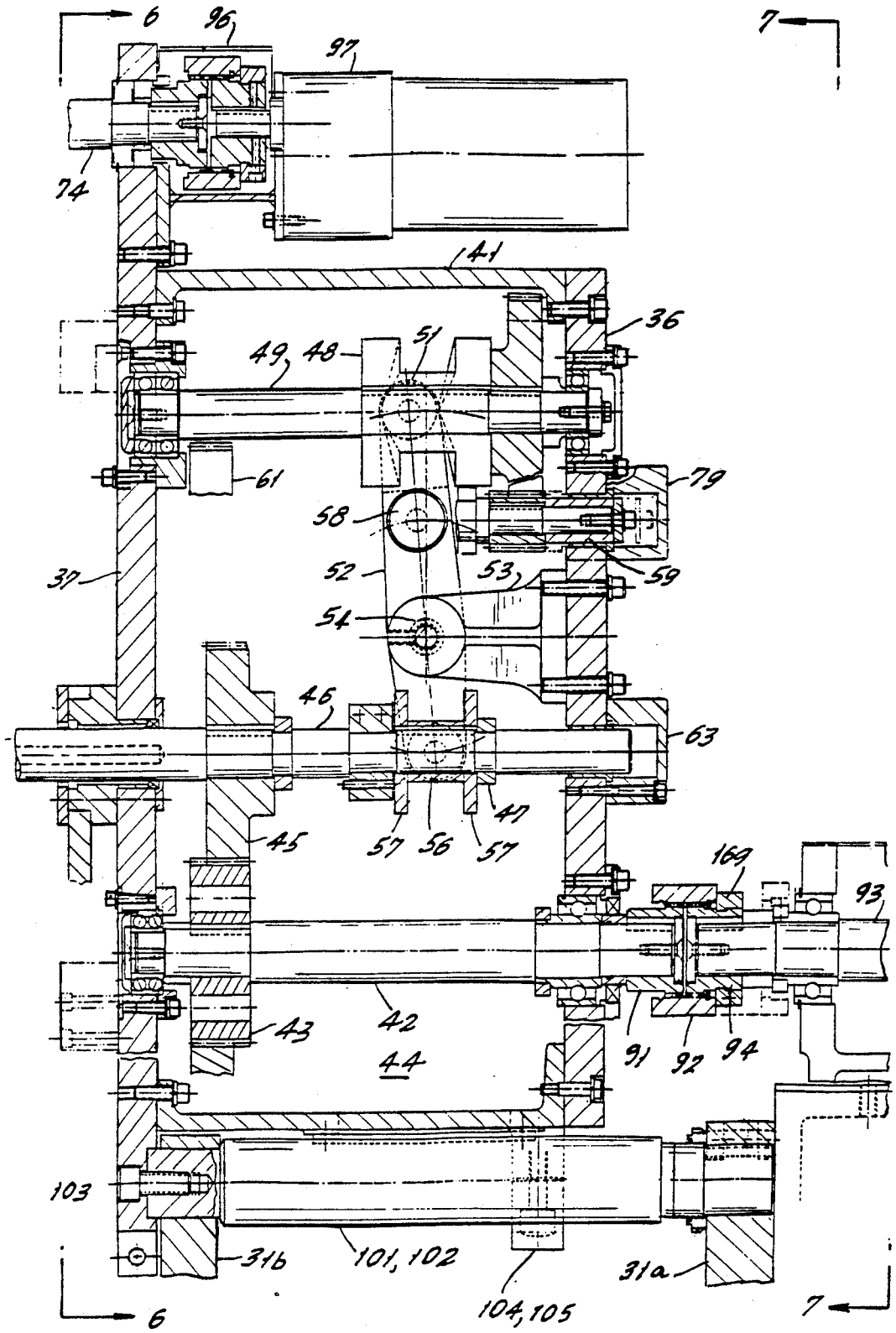
FIG. 4 is a developmental end view of the transmission section with the near wall of its housing removed.
Figure 6:
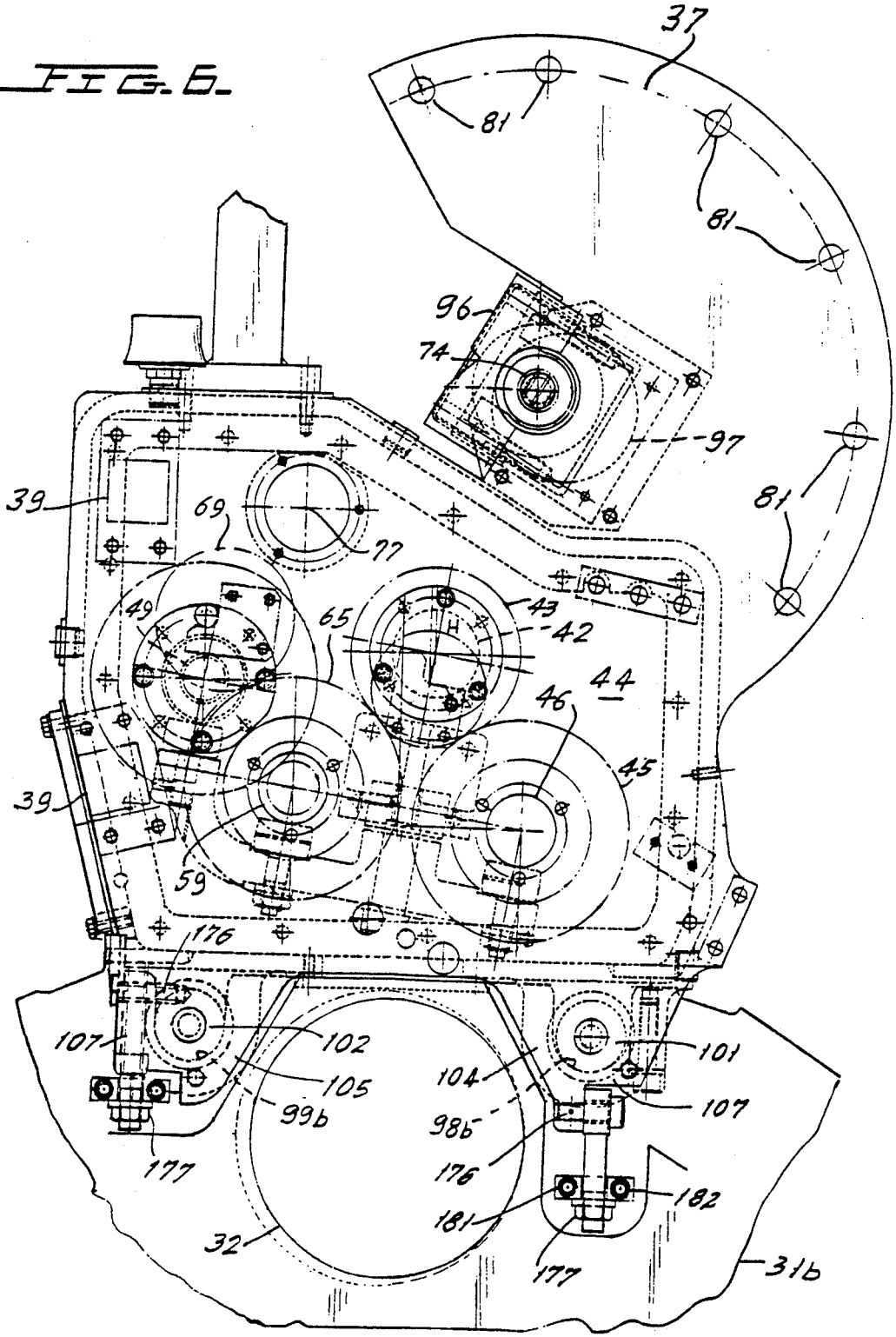
FIG. 6 is a side elevation of the transmission section looking in the direction of arrows 6—6 of FIG. 4.
Figure 7:
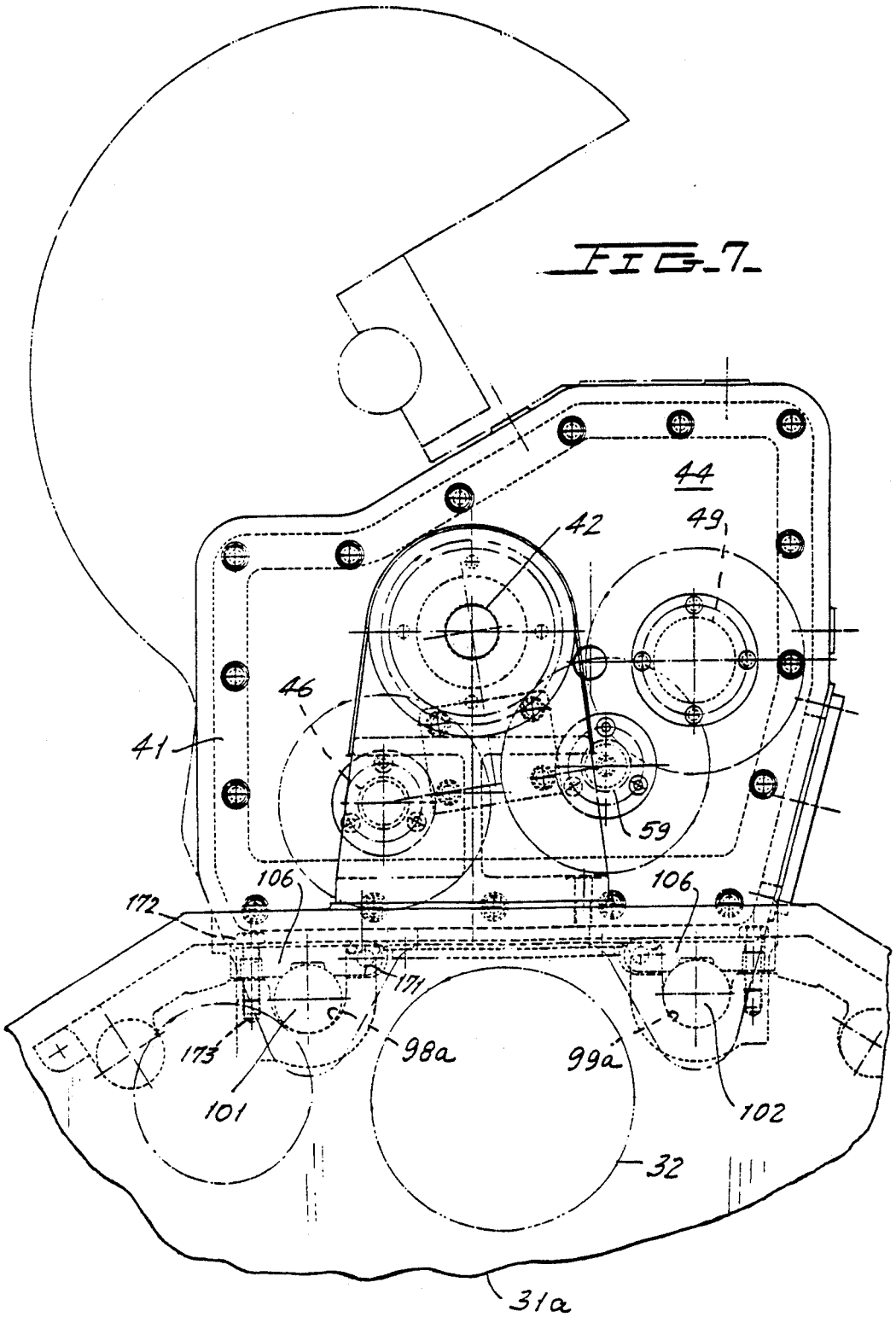
FIG. 7 is a side elevation of the transmission section looking in the direction of arrows 7—7 of FIG. 4.

Now referring more particularly to FIGS. 4, 6 and 7 for a description of the transmission section that includes input shaft 42 having drive gear 43 keyed thereto and disposed within enclosure 44. The latter is defined by closed loop wall element 41 and side plates 36, 37. Drive gear 43 is in mesh with gear 45, keyed to horizontally oscillating shaft 46 having collar 47 mounted thereon, in such a manner that shaft 46 is free to rotate with respect to collar 47 without the latter moving along the axis of shaft 46 while it is being reciprocated through the action of cam 48 that is keyed to shaft 49 so as to rotate therewith. Cam 48 is in a fixed axial position on shaft 49. Cam 48 drives follower 51 constituted by a roller at one end of rocker arm 52 which is pivotally mounted to clevis 53 by pivot pin 54. Mounted to the end of arm 52 remote from cam follower 51 is drive roller 56 that is disposed between spaced collar formations 57, 57 of collar 47. Pivot 54 for rocker arm 52 is disposed midway between drive roller 56 and another drive roller 58 that reciprocates another shaft 59 (FIG. 8 in the same way that driver 56 reciprocates shaft 46, except that the motions of shaft 46 and 59 are 180° out of phase. Shaft 49 having cam 48 thereon also has keyed thereto gear 61 that is driven by gear 43. As cam 48 rotates follower 51, disposed in peripheral cam groove of cam 48, is horizontally oscillated thereby rocking arm 52 about its pivot 54. This oscillates roller 56 to impart axial reciprocating motion to shaft 46 and in the same way drive roller 58 imparts axial reciprocating motion to shaft 59.

The mid region of reciprocating shaft 46 extends through plate 37 and is supported by sliding seal 62. The ends of shaft 46 are supported by bearings at plates 36 and 38. Cap 63 disposed outside of enclosure 44 prevents leakage of liquid lubricant through the bearing for shaft 46 at plate 36. The mounting of shaft 59 is the same as the mounting of shaft 46.

Figure 5:
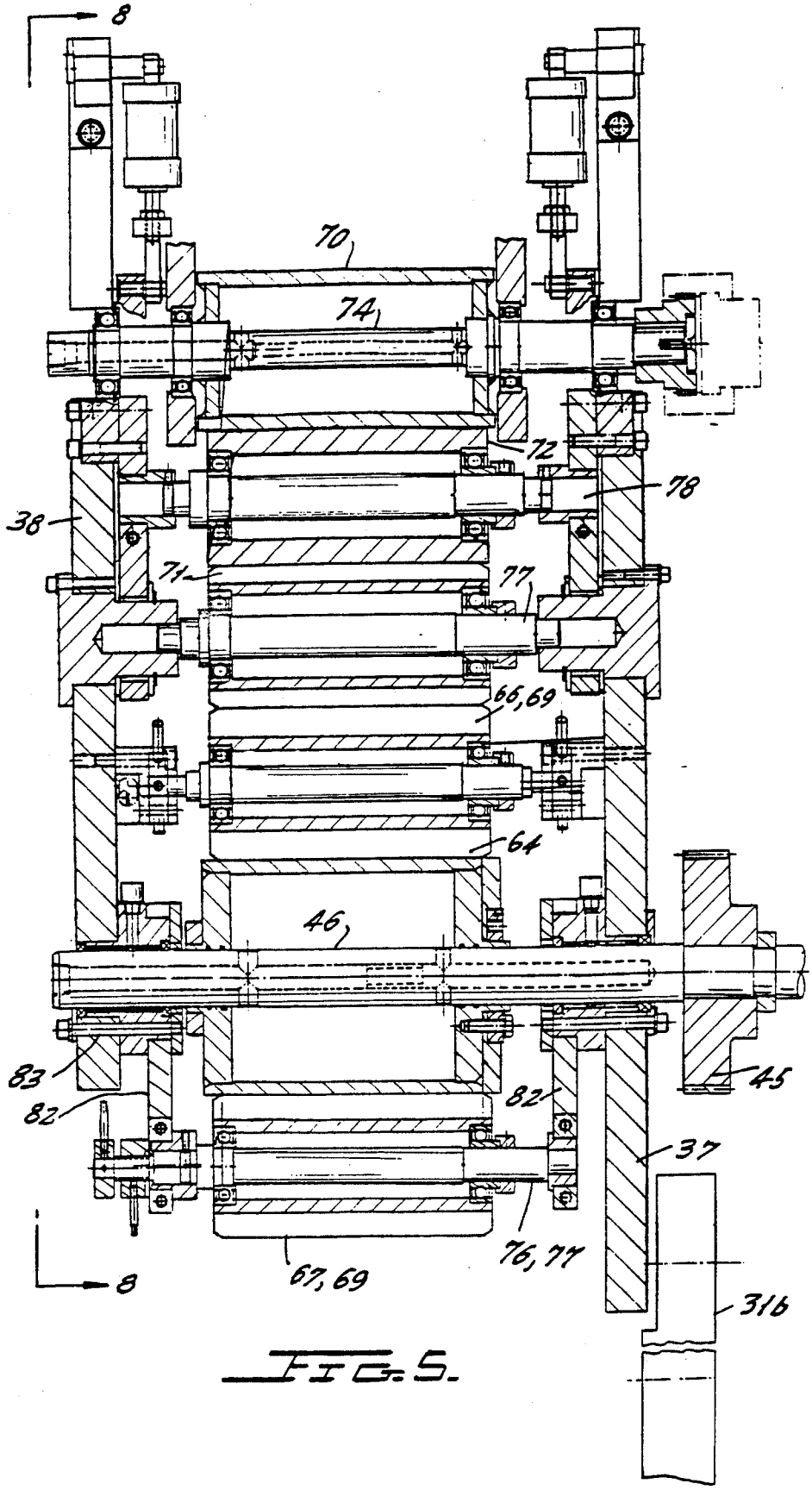
FIG. 5 is a developmental end view of the ink applicator section.

Disposed within the space between plates 37 and 38 are steel vibrator rollers 64, 65 (FIGS. 5 and 8) that are keyed to the respective shafts 46, 59 so as to rotate and oscillate in unison therewith. Through frictional engagement, rotation of roller 64 imparts rotation to distribution roll 66 and form roll 67. Roller 65 rotates form roll 68 and distributor roll 69 which engage the periphery of roller 65. The latter is also engaged by roller 66. Peripherally engaged distribution rollers 71, 72 are interposed between roller 69 and fountain roll 70 whose periphery is engaged by the free edge of doctor blade 33. The periphery of roll 70 partly defines the pool or fountain 73 of ink within pan 75. The latter is mounted to pivot about a center coinciding with axis 74 for fountain roll 70. In a manner known to the art, the attitude of pan 75 is adjustably positionable to predetermined positions dictated by a plurality of frame apertures 81.

The end of shaft 42 remote from gear 43 projects through plate 36 and is disposed outboard thereof. This portion of shaft 42 mounts spline 91 that is engaged by slidable collar 92 mounted to driving shaft 93. When inker subassembly 35 is mounted to main frame 31, shafts 42 and 93 are in axial alignment so that collar 92 may be moved axially to the left with respect to shaft 93 to partially overlap spline 91 on shaft 42 and at the same time continue to overlap a portion of spline 94 on shaft 93. Thus, the internal teeth of collar 92 are now in driving engagement with both shafts 42 and 93 so that rotation of shaft 93 will cause shaft 42 to rotate. Shaft 93 is driven by the main drive that rotates mandrel wheel 18, printing blanket 21 and transfer wheel 27.

Fountain roll shaft 74 is connected through gear coupling 96 to variable speed gear-head motor 97 so that the rotational speed of fountain roll 70 may be adjusted independently of overall machine speed. However, the speed of gear-head motor 97 will vary as a function of the speed for the motor that drives shaft 93. Thus, the speed of fountain roll 70 follows the speed of the main drive for the decorator so that the speed of fountain roll 70 adjusts proportionally, both upward and downward, with decorator speed and as a result ink flow is a function of decorator speed.

The position of doctor blade 33 controls the thickness of the ink film that is formed on fountain roll 70 and transmitted by a chain of distribution (form, transfer, etc.) rollers to the printing plate or plates on plate cylinder 32. The ink film proceeds in order from fountain roll 70 to roll 72, roll 71, roll 69 and roll 65. From the latter there are two paths to the plate cylinder 32. One path is directly from roll 65 through form roll 68 and the other path is from roll 65 through roll 66, roll 64, and roll 67. Approximate operation of power cylinders 87, 187 is effective to retract form rolls 67 and 68 from plate cylinder 32 to dismount inker unit 35 and to remove plate cylinder 32, as well as to stop ink from being applied to the latter.

The metering gap between metering roll 72 and fountain roll 70 is set so that the former picks up a selected volume of ink. Metering roll 72 provides a continuous, smooth and uniform flow of ink directly to transfer roll 71. These two rolls 71, 72 run at the same speed. In contrast, a conventional doctor roll oscillates between fountain and transfer rolls to provide a band of ink that must be spread evenly by distributor rolls. Thus, a conventional ductor roll speeds up and slows down depending upon whether it is engaged with a faster transfer roll or a slower fountain roll.

Vertically extending spaced parallel elements 31*a*, 31*b* of main frame 31 support inker subassemblies 35, with edges of the former having indexing depressions for locating inker subassemblies 35. That is, for each inker location main frame element 31*a* is provided with indexing depressions 98*a*, 99*a* that are aligned with indexing depressions 98*b*, 99*b*, respectively, of main frame element 31*b*. Cylindrical mounting rod or shaft 101 extends between main frame sections 31*a* and 31*b*, and is received by indexing depressions 98*a*, 98*b*, while cylindrical mounting rod or shaft 102 extends between main frame sections 31*a* and 31*b* and is received by indexing depressions 99*a* and 99*b*. Mounting rods 101, 102 are elements of subassembly 35. An individual bolt 103, (FIG. 4), secures one end of each of the shafts 101, 102 to frame plate 37. In the vicinity of frame plate 36, rods 101, 102 extend through apertures in respective legs 104, 105 that project from wall forming element 41.

Straps 106 connected to main frame element 31*a*, secures mounting shafts 101, 102 within indexing depressions 98*a*, 99*a*, and tie rods 107 hold shafts 101, 102 in indexing depressions 98*b*, 99*b*.

The free edge of main frame element 31*a* is provided with an individual pair of apertures 98*a*, 99*a* for locating each inker subassembly 35. For this same purpose, main frame element 31*b* includes an individual locating depression 98*b* in alignment with each depression 98*a* and an individual depression 99*b* disposed in alignment with each depression 99*a*.

More particularly, as seen in FIG. 7, each strap 106 is pivotally mounted to main frame member 31*a* each on a pin 171 that is disposed at one end of strap 106. At its other end strap 106 mounts clamping screw 172 that enters a tapped hole 173 to hold strap 106 in the securing position shown. As seen in FIG. 6, there are two threaded tie rods 107 to clamp each inker assembly 35 in the vicinity of main frame member 31*b*. Pin 176 at the upper end of tie rod 107 pivotally mounts the latter to legs 104, 105 through which the respective support rods 101, 102 extend. Mounted at the lower end of tie rod 107 is clamping nut 177 that is positioned below U-shaped member 178 which is secured to main frame member 31*b* in a position such that arms 181 and 182 extend horizontally and toward the reader with respect to FIG. 6. With rod 175 pivoted downward to the position shown in FIG. 6 it extends between bracket arms 181, 182 and nut 177 is disposed below these arms 181, 182. Tightening of nut 177 against member 178 secures the unit to main frame member 31*b* and firmly seats rods 101 and 102 in the locating depressions where they are disposed.

Thus, it is seen that mechanically mounting and dismounting of an inker subassembly 35 is accomplished relatively quickly by operating two readily accessible screws 172, 172 and two readily accessible nuts 177, 177, and coupling or decoupling inker 35 from the main drive for the decorator. To decouple, split collar portion 110 (FIG. 4) of collar-type coupling 9 loosened and collar 94 is moved to the right on driving shaft 93 until the left end of coupling 92 clears the right end of input shaft 42.

When skew and/or pressure adjustments for shafts 76, 55 of the respective transfer rolls 67, 68 are required, such adjustments are made by operating knobs 84*a*, 85*a* on the respective essentially parallel shafts 84, 85 (FIG. 9) that have fixed rod 83 disposed therebetween.

More particularly, shaft 55 is mounted at the lower ends of links 82, 82 (FIGS. 8 and 9) whose upper ends are pivotally mounted on shaft 59 of oscillating roll 65. A pair of pressure cylinders 87, 87 are interposed between links 82, 82 and frame plates 37, 38. That is, pins 201, 201 pivotally connect cylinders 87, 87 to links 82, 82 and pins 202, 202 pivotally connect cylinders 87, 87 to frame plates 37, 38. Links 82, 82 support rod 85 near opposite ends thereof. When cylinders 87, 87 are actuated, links 82, 82 pivot counterclockwise with respect to FIG. 8 about shaft 59 as a center and form roll 68 is driven against the printing plate (not shown) on the periphery of print cylinder 32. Mounted near opposite ends of shaft 85 are relatively movable conical stops 51*a*, 52*a* that engage the respective conical stops 151, 152 that are fixedly mounted on shaft 83 near opposite ends thereof. The engagement between stops 51*a*, 52*a* and 151, 152 limits movement of roll 68 toward the periphery of plate cylinder 32. By adjusting stops 51*a* and 51*b* to the left with respect to FIG. 9, the permitted movement of roll 68 toward cylinder 32 is increased.

Conical stop 51*a* is at the right end of tubular member 153 having both internal and external threads 154 and 155. Internal threads 154 mate with threaded portion 85*c* of shaft 85 and external thread 155 mate with internal threads in the bore of arm 82 through which member 153 extends. Relatively movable stop 52*a* is at the right end of tubular member 156 and is provided with internal threads that mate with threaded portion 85*b* of rod 85. Once the position of member 156 along rod 85 is selected, the former is fixed in place by tightening set screw 157. The right end of shaft 85 is supported for axial movement by sleeve 158 in aperture 159 of the righthand link 82.

Figure 9:
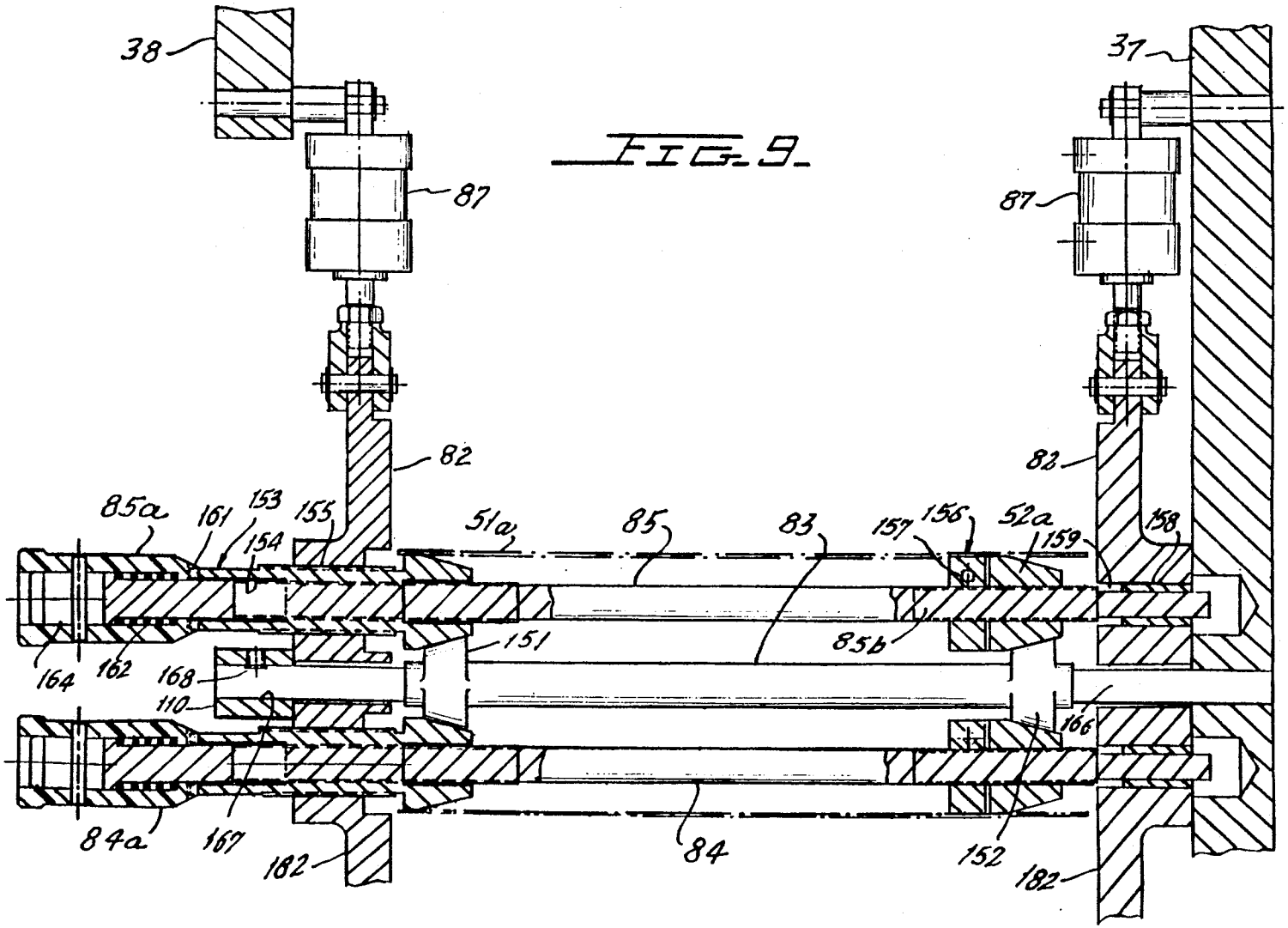
FIG. 9 is a developmental longitudinal cross-section through the shafts for adjusting skew and pressure of form rollers relative to the plate cylinder.

At interface 161 the left end of member 153 is provided with serrations that are engageable with complementary serration in the right end of knob 85*a* to form a separable driving connection therebetween when knob 85*a* is in its engaged position of FIG. 9, being held in that position by coiled compression spring 162 that surrounds shaft 85 and bears against shoulder 185 at the left end thereof. Pin 163 extends through elongated clearance slot 164 to the left of spring 162 to form a driving connection between knob 85*a* and rod 85.

The right end of rod 83 is disposed within aperture 166 of frame member 37 and the left end of shaft 83 is disposed within aperture 167 in downward extension 110 of frame member 38. Set screw 168 extends through extension 110 to secure shaft 83 against axial movement.

With knob 85 in its engaged position of FIG. 9 rotation of knob 85 is effective to rotate member 153 and by so doing external threads 155 cause axial movement of stop 51*a*. The same degree of axial movement is imparted to stop 52*a* in that the engagement of threads 154, 85*c* causes rod 85 to move axially because the latter is, to all intent and purpose, locked to member 153 because rotational movement imparted to member 153 by knob 85 imparts the same rotational movement to rod 85*a* through drive pin 163.

When knob 85*a* is moved against the force of spring 162, to the left with respect to FIG. 9 so that the driving connection at interface 161 is broken, rotation of knob 85*a* no longer rotates member 153 so that stop 51*a* is held against axial movement by external threads 155. However, pin 163 continues to provide a driving connection between knob 85*a* and rod 85 so that the latter rotates and in so doing the cooperation of rod threads 85c with the now stationary internal threads 154 of member 153 cause axial movement of shaft 85 and stop 52a locked thereto. It should now be apparent to those skilled in the art that when stops 51a and 52a are moved axially relative to one another, skew adjustment is effected and when stops 51a and 52a move axially, in unison, pressure between distribution roll 68 and print cylinder 32 is adjusted.

The other distribution roll 67 that engages cylinder 32 is mounted at the lower end of arm 182 whose upper end is pivotally mounted on oscillating shaft 46. A pair of power cylinders 187 extend between stationary frame members 37, 38 and the pair of links 182, 182 that are at opposite ends of shaft 84. The latter is mounted in the same way that shaft 85 is mounted and mounts a separate set of stop and adjusting elements identical to those elements 154, 156, 162 mounted on shaft 85.

It is noted that liquid lubricant will not leak out of transmission enclosure 44 during removal and/or replacement of inker unit subassembly 35, since the elements forming enclosure 44 are sealed together and liquid tight seals are provided for all openings through which shafts project outside of enclosure 44. Further, with a decorator constructed as hereinbefore described, an operator can make all needed adjustments for operating the decorator from the operator's side of the machine.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for decorating cylindrical articles, said apparatus including:

a main frame, a blanket wheel rotatably mounted on said main frame, a plurality of plate cylinders rotatably mounted on said main frame and disposed adjacent the periphery of said blanket wheel whereby printing plates mounted on said plate cylinders engage the periphery of said blanket wheel as the latter rotates in timed relationship with rotation of said plate cylinders, and a plurality of inker subassemblies removably mounted on said main frame to apply controlled amounts of ink to printing plates mounted on said plate cylinders, there being an individual one of said inker subassemblies associated with each of said plate cylinders, and said plate cylinders remaining mounted on the main frame upon dismounting of the subassemblies from the main frame;

each of said subassemblies comprising first and second sections disposed in side by side relationship;

said first section including a fountain for holding a supply of ink and first means for removing ink from said fountain, forming ink removed from said fountain into a thin film and applying the latter to a printing plate on the plate cylinder that is associated with the subassembly in question, said first means including a train of cylinders;

said second section including a transmission for positively driving a first cylinder of said train of cylinders, a liquid-type lubricant for lubricating said transmission, said transmission having an input and an output with the latter being operatively connected to said first cylinder, a housing for confining said lubricant when said subassembly is mounted on and dismounted from said main frame, and wherein said transmission is disposed;

drive means mounted on said main frame and including an individual driving shaft for each of said subassemblies;

said input including an input shaft that is in axial alignment with an individual one of said driving shafts;

an individual second means associated with each of said subassemblies, said second means being disposed externally of the housings and providing disengageable couplings for independently connecting each of said input shafts to said drive shafts in axial alignment therewith so that they rotate at the same speed.

2. Apparatus for decorating cylindrical articles as set forth in claim 1 in which each of the couplings includes a collar that is slidable axially with respect to said input shaft and said driving shaft axially aligned therewith.

3. Apparatus for decorating cylindrical articles as set forth in claim 2 in which the collars include internal spline formations that complement external spline formations on the input shaft.

4. Apparatus for decorating cylindrical articles as set forth in claim 1 in which the first section also includes a doctor blade, and the train of cylinders also includes a fountain cylinder and a frictionally driven form roll;

said form roll being downstream of said first cylinder and operatively engaged with a printing plate on the plate cylinder;

said fountain cylinder being upstream of said first cylinder and in operative engagement with said doctor blade.

5. Apparatus for decorating cylindrical articles as set forth in claim 4 in which the train also includes a metering roll and a transfer roll, both rotating at the same speed and being upstream of said first cylinder;

said metering roll being separated laterally from said fountain cylinder to form a narrow gap therebetween that is adjustable to control the amount of ink picked up by said metering roll;

said fountain cylinder, said metering roll and transfer roll rotating on parallel axes that remain fixed while said apparatus is decorating cylindrical articles.

6. Apparatus for decorating cylindrical articles as set forth in claim 4 in which the first section also includes means for adjusting pressure of engagement between said form cylinder and the printing plate.

7. Apparatus for decorating cylindrical articles as set forth in claim 6 in which the means for adjusting pressure of engagement includes means for independently repositioning the respective ends of the form cylinder independently of one another.

8. Apparatus for decorating cylindrical articles, said apparatus including:

a main frame, a blanket wheel rotatably mounted on said main frame, a plurality of plate cylinders rotatably mounted on said main frame and disposed adjacent the periphery of said blanket wheel whereby printing plates mounted on said plate cylinders engage the periphery of said blanket wheel as the latter rotates in timed relationship with rotation of said plate cylinders, and a plurality of inker subassemblies removably mounted on said main frame to apply controlled amounts of ink to printing plates mounted on said plate cylinders, there being an individual one of said inker subassemblies associated with each of said plate cylinders, and said plate cylinders remaining mounted on the main frame upon dismounting of the subassemblies from the main frame;

each of said subassemblies comprising first and second sections disposed in side by side relationship;

said first section including a fountain for holding ga supply of ink and first means for removing ink from said fountain, forming ink removed from said fountain into a thin film and applying the latter to a printing plate on the plate cylinder that is associated with the subassembly in question, said first means including a train of cylinders;

said second section including a transmission for positively driving a first cylinder of said train of cylinders, a liquid-type lubricant for lubricating said transmission, said transmission having an input and an output with the latter being operatively connected to said first cylinder, a housing for confining said lubricant and wherein said transmission is disposed;

drive means mounted on said main frame, and an individual second means associated with each of said subassemblies, said second means being disposed externally of the housings and providing disengageable couplings for independently connecting each of said inputs to said drive means;

each of said subassemblies including first, second and third parallel plates with said second plate being disposed between said first and said third plates;

said first section being disposed between said first and said second plates;

said second section being disposed between said second and said third plates;

said output including an output shaft that extends through said second plate and toward said first plate;

said input including an input shaft for coupling to said drive means, said input shaft extending through said third plate and away from said second plate.

9. Apparatus for decorating cylindrical articles as set forth in claim 8 in which the main frame is provided with an individual set of formations to operatively locate each of said subassemblies on said main frame;

said set of formations having first and second portions located in the vicinity of said second and third plates, respectively.

10. Apparatus for decorating cylindrical articles as set forth in claim 9 in which the first portion includes substantially spaced first and second depressions, and the second portion includes substantially spaced first and second depressions that are substantially spaced from said first and second depressions of said first portion.

11. Apparatus for decorating cylindrical articles as set forth in claim 10 in which each of the subassemblies includes first and second support rods extending parallel to said shafts;

said first rod being seated in both of said first depressions and said second rod being seated in both of said second depressions.

12. Apparatus for decorating cylindrical articles as set forth in claim 11 in which the main frame includes first and second frame plates that are vertical and spaced apart;

said depressions being open along the edges of said frame plates;

and releasable strap means operatively connecting said main frame and said subassemblies to retain said rods seated in said depressions.

13. Apparatus for decorating cylindrical articles as set forth in claim 12 in which spacing between said frame plates is in the order of spacing between said second and said third plates of said subassemblies.

14. Apparatus for decorating cylindrical articles as set forth in claim 8 in which said transmission also includes means comprising operatively engaged elements that cooperate upon rotation of said input shaft to rotate and axially reciprocate said output shaft as well as the first cylinder.

* * * * *